US011156216B2

(12) United States Patent
Yang

(10) Patent No.: US 11,156,216 B2
(45) Date of Patent: Oct. 26, 2021

(54) ZIPPER TAB ASSEMBLY WITH EXHAUSTING/INFLATING FUNCTIONS

(71) Applicant: Universal Trim Supply Co., Ltd., New Taipei (TW)

(72) Inventor: Shih-Sheng Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 352 days.

(21) Appl. No.: 16/246,554

(22) Filed: Jan. 14, 2019

(65) Prior Publication Data

US 2020/0132062 A1 Apr. 30, 2020

(30) Foreign Application Priority Data

Oct. 31, 2018 (CN) ..... 201811285415.2

(51) Int. Cl.
*F04B 35/04* (2006.01)
*A44B 19/26* (2006.01)
*F04B 37/00* (2006.01)

(52) U.S. Cl.
CPC ..... *F04B 35/04* (2013.01); *A44B 19/262* (2013.01); *F04B 37/00* (2013.01)

(58) Field of Classification Search
CPC ..... A44B 19/262; F04B 27/0852; F04B 27/0891; F04B 27/1081; F04B 35/04; F04B 37/00; F04B 39/12; F04B 39/121; F04B 2201/08; F04C 2240/30; F04D 29/40; F04D 29/403; F04D 29/406; F04D 29/42; F04D 29/4206; F04D 29/4213; F04D 29/4226; F04D 29/4253
See application file for complete search history.

(56) References Cited

U.S. PATENT DOCUMENTS 5,257,913 A * 11/1993 Schwarzer ..... F04C 23/008 417/234
7,845,048 B1 * 12/2010 Bailey ..... E01H 1/0863 15/327.5
7,903,408 B1 * 3/2011 Yu ..... H05K 5/0278 174/16.1
2015/0100045 A1 * 4/2015 Allen ..... F04B 43/04 604/543
2017/0215744 A1 * 8/2017 Kawamura ..... F04B 43/046

* cited by examiner

*Primary Examiner* — Dominick L Plakkoottam
*Assistant Examiner* — Charles W Nichols
(74) *Attorney, Agent, or Firm* — Winston Hsu

(57) ABSTRACT

The present invention discloses a zipper tab assembly with exhausting and/or inflating functions. The zipper tab assembly includes a housing, an electric air pump disposed inside the housing and configured to exhaust or inflate, and a power terminal having an input port and an output port. The input port protrudes out of the housing, and the output port is disposed inside the housing and electrically connected to the electric air pump. The zipper tab assembly further includes a hook disposed outside the housing and connected to the housing. The zipper tab assembly of the present invention has exhausting and/or inflating functions and has the advantages of practicability, convenient utilization, small size, light weight, convenient wearing and convenient carrying.

8 Claims, 5 Drawing Sheets

ZIPPER TAB ASSEMBLY WITH EXHAUSTING/INFLATING FUNCTIONS

BACKGROUND OF THE INVENTION

1. Field of the Invention

The present invention relates to a zipper tab assembly, and more particularly, to a zipper tab assembly with exhausting/inflating functions.

2. Description of the Prior Art

A zipper tab is mainly used for clothing or luggage and cooperates with a zipper. The zipper tab can be made of zinc alloy, copper, iron, plastic and other materials to meet different needs. Various colors can be electroplated on a surface of the zipper tab, and different patterns, letters, shapes and other styles also can be formed on the surface of the zipper tab by laser, silk screen, resin, etc. Furthermore, the zipper tab can be formed in a rotary type or a bending type according to a size of a zipper head. The current zipper tab is small in shape and easy to hang on the zipper head of clothes or bags, its function is only limited to pull the zipper head so as to open or close the zipper, and the current zipper tab does not have other extra functions.

SUMMARY OF THE INVENTION

Therefore, an objective of the present invention is to provide a zipper tab assembly with exhausting/inflating functions and with advantages of practicability, convenient utilization, convenient wearing and convenient carrying.

In order to achieve the aforementioned objective, the present invention discloses a zipper tab assembly with exhausting and/or inflating functions. The zipper tab assembly includes a housing, an electric air pump disposed inside the housing and configured to exhaust or inflate, and a power terminal having an input port and an output port. The input port protrudes out of the housing, and the output port is disposed inside the housing and electrically connected to the electric air pump. The zipper tab assembly further includes a hook disposed outside the housing and connected to the housing.

The zipper tab assembly has pull function and at least one of exhausting and inflating functions by the electric air pump. Besides, the zipper tab assembly does not have any battery but uses a power terminal to connect with an external power source, such as a mobile phone or a mobile power source, which conforms to the current status of popular mobile phones, and it can safely pass the X-ray detector of the customs for smooth boarding. Moreover, there is no need to reserve extra space inside the zipper tab assembly for the battery, so the volume of the zipper tab assembly can be made small and the weight of the zipper tab assembly can be light. The hook of the zipper tab assembly can be easily hung on a zipper head of the clothes or the luggage. Or the hook can be hung on the keychain or the key case as an accessory for the user to carry around.

The zipper tab assembly of the present invention has exhausting and/or inflating functions and has the advantages of practicability, convenient utilization, small size, light weight, convenient wearing and convenient carrying, which is beneficial for home or travel.

Specifically, the electric air pump includes at least one of a vacuum extraction nozzle and an inflation nozzle, and the vacuum extraction nozzle and the inflation nozzle are communicated with an exterior of the housing. The vacuum extraction nozzle and the inflation nozzle can connect with vent holes of a bag body of an external device, so as to vacuum or inflate the bag body.

Specifically, the housing includes a first shell wall, a second shell wall, a first lateral wall and a second lateral wall, the first shell wall and the second shell wall are parallel to each other and formed in an isosceles trapezoid shape, an upper edge of each of the first shell wall and the second shell wall is less than 30 mm, a lower edge of each of the first shell wall and the second shell wall is less than 40 mm, a height of each of the first shell wall and the second shell wall is less than 110 mm, the first lateral wall is connected around the first shell wall, the second lateral wall is connected around the second shell wall, a power interface is disposed on sides of the first lateral wall and the second lateral wall corresponding to the upper edges of the first shell wall and the second shell wall, an exhausting and inflating interface is disposed on sides of the first lateral wall and second lateral wall corresponding to the lower edges of the first shell wall and the second shell wall, the vacuum extraction nozzle and the inflation nozzle of the electric air pump protrude out of the housing through the exhausting and inflating interface, and the input port of the power terminal protrudes out of the housing through the power interface. The above structural design of the housing makes the overall shape of the zipper tab assembly similar to the existing zipper tab and also similar to a key fob of a car. The appearance of the zipper tab assembly does not appear abrupt, and the zipper tab assembly can be hung on the zipper head of clothes or the bag by the hook, and it can pull the zipper head to open or close the zipper. The zipper tab assembly also can be hung on the keychain or the key case as an accessory.

Specifically, the zipper tab assembly further includes a protecting cover sheathing with the housing. The protecting cover is a hollow structure enclosed by a first cover wall, a second cover wall, a third cover wall and a fourth cover wall. The first cover wall and the second cover wall are disposed opposite to each other and located outside the first shell wall and the second shell wall. The protecting cover is rotatably connected to the housing via a rotary mechanism. When the protecting cover rotates to a position where the third cover wall covers the power interface, the fourth cover wall covers the exhausting and inflating interface, and the first cover wall and the second cover wall respectively cover the first shell wall and the second shell wall.

When the exhausting and inflating functions are not utilized, the protecting cover can be folded with the housing, so as to cover the input port of the power terminal, the vacuum extraction nozzle and the inflation nozzle. When it is desired to utilize the exhausting and inflating functions, the protecting cover can be rotated relative to the housing, so as to expose the input port the power terminal, the vacuum extraction nozzle and the inflation nozzle.

Specifically, two arc notches are formed on the first cover wall and the second cover wall and located in positions corresponding to each other. When the protecting cover is to be opened, the user can first grasp the housing exposed out of the arc notches and then rotate the protecting cover to open it, so as to expose the output port of the power terminal, the vacuum extraction nozzle/or and the inflation nozzle, for exhausting or inflating operation. By the structural design of the arc notches, it is convenient for the user to stabilize the housing when opening the protecting cover, which prevents the housing from being interlocked as the protecting cover is rotated, and is beneficial to the smooth opening and closing operation of the protecting cover.

Specifically, a total weight of the zipper tab assembly is less than 50 grams, so that it does not bring excessive weight burden on the zipper head of the user's clothes or backpack.

Specifically, the electric air pump has a suitable volume of less than 10 L, a maximum inflation pressure of less than 10 psi, a minimum vacuum negative pressure of no more than −10 psi, and a maximum flow rate of less than 5 L/min. The zipper tab assembly is suitable for inflating an air bag of an inflatable backpack, inflatable clothes, an inflatable pillow, a balloon, a lifebuoy, etc., and is also suitable for pumping a bag that needs to be vacuumed, such as a food bag, a clothes storage bag, and the like.

Specifically, the input port of the power terminal can be a micro-USB plug, a Lighting plug, a Type-C plug, and so on. The input port can be inserted into a corresponding socket of a mobile phone, a mobile power source, a charger or a computer, to receive electrical power, which is easy to use.

Specifically, when the electric air pump is powered by a 3V power supply, an average current can be less than 450 mA and a maximum current can be less than 600 mA. When the electric air pump is powered by a 5V power supply, the average current can be less than 250 mA and the maximum current can be less than 350 mA. Taking the mobile phone power as an example, as it takes about one minute each time, it only consumes less than one percent of the mobile phone power.

Specifically, the hook can be a clasp detachably connected to the housing, such as a lobster clasp. The zipper tab assembly can be hung on a zipper head of clothes or the bag by the hook, and it is easy to take out the zipper tab assembly for exhausting or inflating operation.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
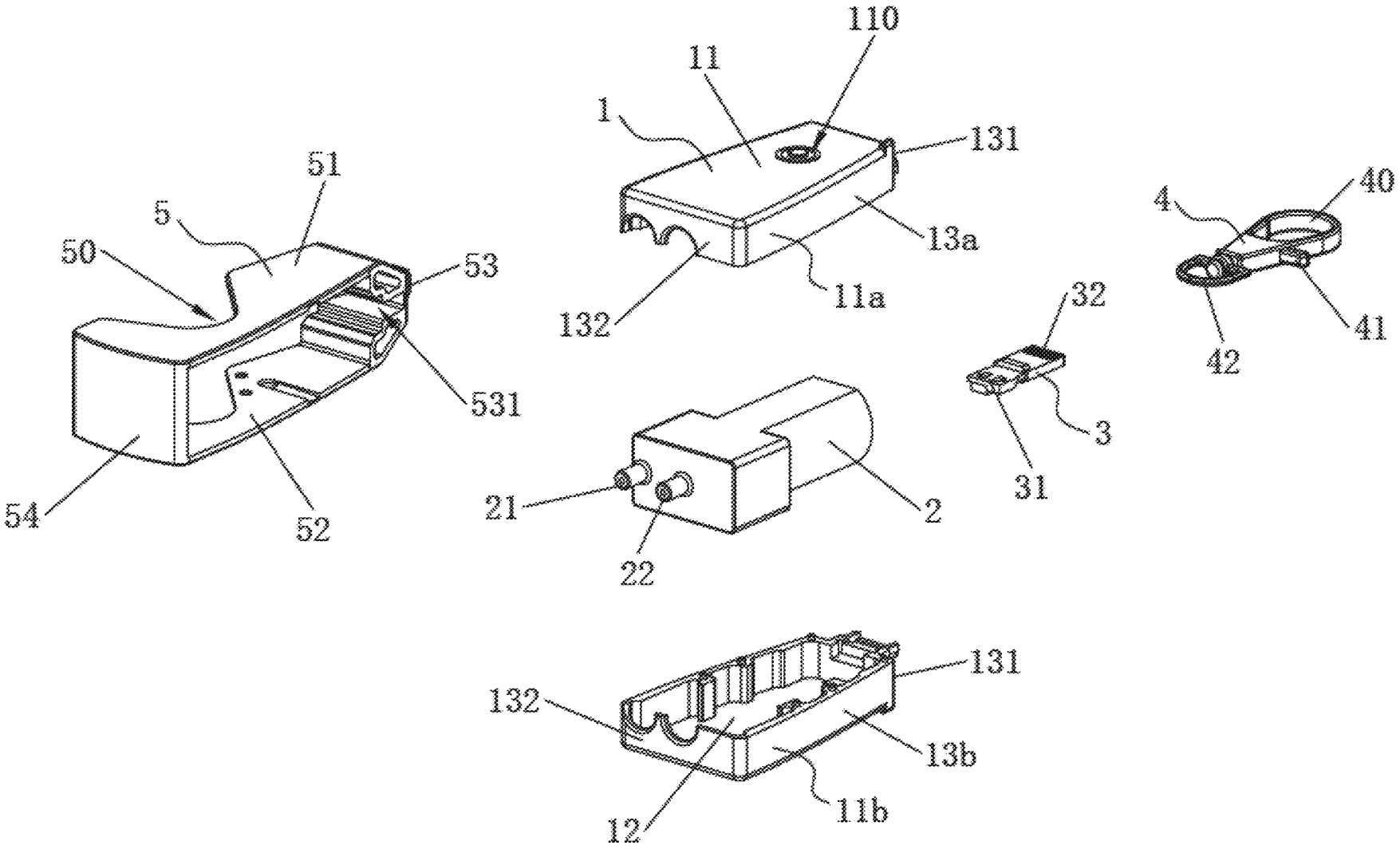
FIG. 1 is an exploded diagram of a zipper tab assembly of the present invention.
Figure 2:
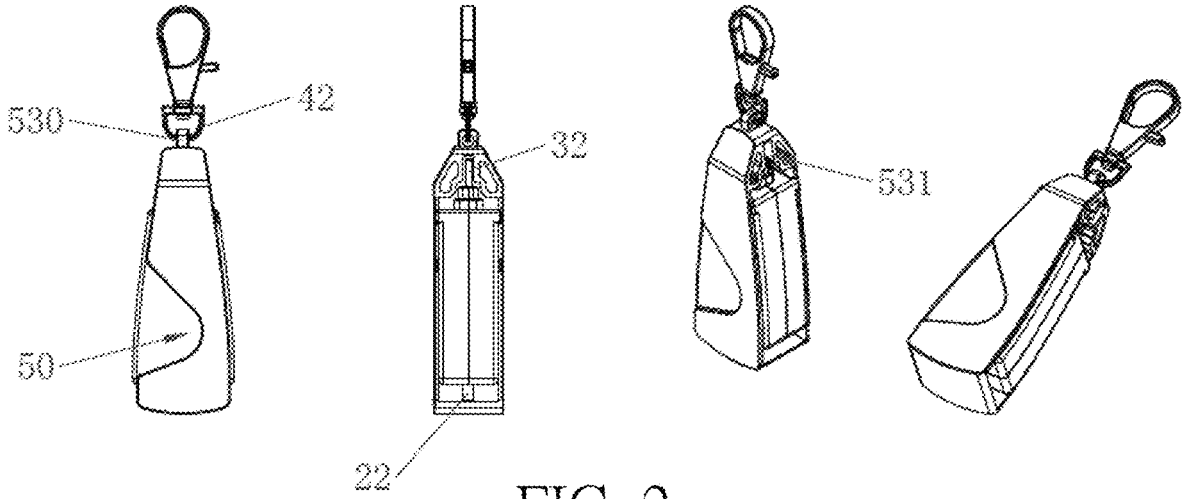
FIG. 2 is a diagram of the zipper tab assembly with a closed protecting cover at different views of the present invention.
Figure 3:
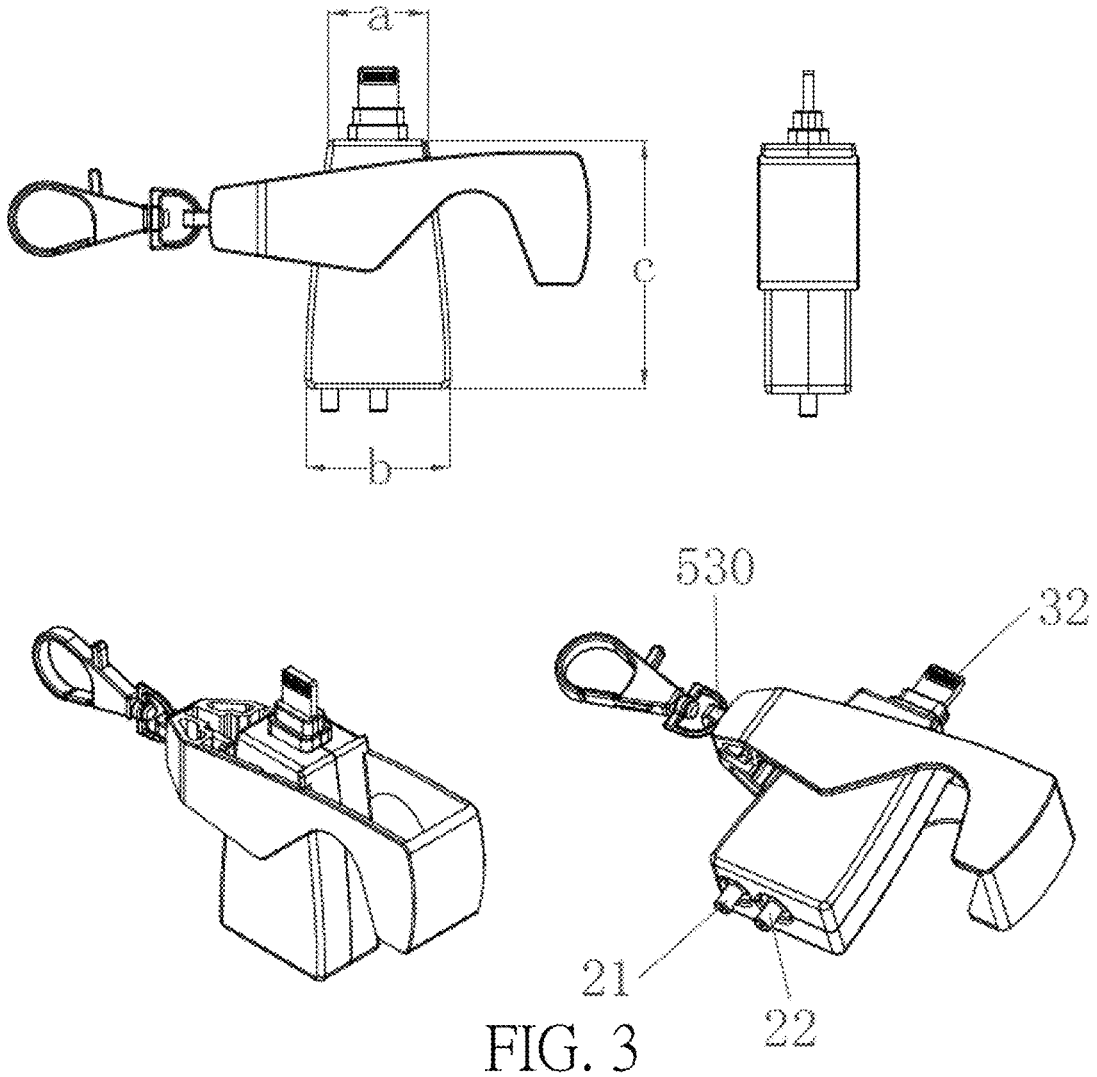
FIG. 3 is a diagram of the zipper tab assembly with the open protecting cover at different views of the present invention.

Please refer to FIG. 1 to FIG. 3. FIG. 1 is an exploded diagram of a zipper tab assembly of the present invention. FIG. 2 is a diagram of the zipper tab assembly with a closed protecting cover 5 at different views of the present invention. FIG. 3 is a diagram of the zipper tab assembly with the open protecting cover 5 at different views of the present invention. The zipper tab assembly with exhausting/inflating functions of the present invention includes a housing 1, an electric air pump 2, a power terminal 3 and a hook 4. The electric air pump 2 is disposed inside the housing 1 and configured to exhaust or inflate. The power terminal 3 includes an output port 31 and an input port 32. The output port 31 of the power terminal 3 is disposed inside the housing 1 and electrically connected to the electric air pump 2, and the input port 32 of the power terminal 3 protrudes out of the housing 1. The hook 4 is disposed outside the housing 1 and connected to the housing 1.

The housing 1 includes a first shell wall 11, a second shell wall 12, a first lateral wall 13*a* and a second lateral wall 13*b*. The first shell wall 11 and the second shell wall 12 are parallel to each other and formed in an isosceles trapezoid shape substantially. An upper edge a of each of the first shell wall 11 and the second shell wall 12 can be less than 30 mm, a lower edge b of each of the first shell wall 11 and the second shell wall 12 can be less than 40 mm, and a height c of each of the first shell wall 11 and the second shell wall 12 can be less than 110 mm. The first lateral wall 13*a* is connected around the first shell wall 11, and the second lateral wall 13*b* is connected around the second shell wall 12. A power interface 131 is disposed on sides of the first lateral wall 13*a* and the second lateral wall 13*b* corresponding to the upper edges a of the first shell wall 11 and the second shell wall 12, and an exhausting and inflating interface 132 is disposed on sides of the first lateral wall 13*a* and second lateral wall 13*b* corresponding to the lower edges b of the first shell wall 11 and the second shell wall 12. Through holes are disposed on the power interface 131 and the exhausting and inflating interface 132.

Specifically, the housing 1 is composed of a first casing 11*a* and a second casing 11*b*. The first casing 11*a* includes the first shell wall 11 and the first lateral wall 13*a* connected around the first shell wall 11. The second casing 11*b* includes the second shell wall 12 and the second lateral wall 13*b* connected around the second shell wall 12. The first lateral wall 13*a* and the second lateral wall 13*b* can be engaged, screwed or adhered with each other. The housing 1 can be made of plastic material with light weight.

The above structural design of the housing 1 makes the overall shape of the zipper tab assembly similar to the existing zipper tab and also similar to a key fob of a car. The appearance of the zipper tab assembly does not appear abrupt, and the zipper tab assembly can be hung on a zipper head of clothes or a bag by the hook 4, and it can pull the zipper head to open or close a zipper. The zipper tab assembly also can be hung on the keychain or the key case as an accessory.

The electric air pump 2 has at least one of exhausting and inflating functions. That is, the electric air pump 2 has the exhausting function or the inflating function, or the electric air pump 2 has both of the exhausting function and the inflating function. The electric air pump 2 includes at least one of a vacuum extraction nozzle 21 corresponding to the exhausting function and an inflation nozzle 22 corresponding to the inflating function, and the vacuum extraction nozzle 21 and/or the inflation nozzle 22 are communicated with an exterior of the housing 1. The vacuum extraction nozzle 21 and/or the inflation nozzle 22 can connect with vent holes of a bag body of an external device. Specifically, the vacuum extraction nozzle 21 and/or the inflation nozzle 22 can be outstretching nozzles, which outstretch to the exterior of the housing 1 through the through holes disposed on the exhausting and inflating interface 132. Alternatively, the vacuum extraction nozzle 21 and/or the inflation nozzle 22 can be retracting nozzles disposed inside the through holes on the exhausting and inflating interface 132. Preferably, the electric air pump 2 includes both of the vacuum extraction nozzle 21 corresponding to the exhausting function and the inflation nozzle 22 corresponding to the inflating function, there are two through holes disposed on the exhausting and inflating interface 132, the vacuum extraction nozzle 21 outstretches to the exterior of the housing 1 through one of the through holes disposed on the exhausting and inflating interface 132, and the inflation nozzle 22 outstretches to the exterior of the housing 1 through the other of the through holes disposed on the exhausting and inflating interface 132.

The electric air pump 2 can have a suitable volume of less than 10 L, a maximum inflation pressure of less than 10 psi, a minimum vacuum negative pressure of no more than −10 psi, and a maximum flow rate of less than 5 L/min, which can meet general needs of daily life. The electric air pump 2 can be a micro air pump. A suitable model of the electric air pump 2 can be directly purchased from the market, or the electric air pump 2 can be customized according to the shape and size of the housing 1, the actual required weight and performance parameters, and so on. The zipper tab assembly is suitable for inflating an air bag of an inflatable backpack, inflatable clothes, an inflatable pillow, a balloon, a lifebuoy, etc., and is also suitable for pumping a bag that needs to be vacuumed, such as a food bag, a clothes storage bag, and the like.

The input port 32 of the power terminal 3 can be a micro-USB plug, a Lighting plug, a Type-C plug, and so on. The input port 32 can be inserted into a corresponding socket of a mobile phone, a mobile power source, a charger or a computer, to receive electrical power, which is easy to use. The input port 32 of the power terminal 3 outstretches to the exterior of the housing 1 through the through hole disposed on the power interface 131. The electric air pump 2 can be powered by a 3V or 5V DC power supply. When the electric air pump 2 is powered by a 3V power supply, an average current can be less than 450 mA and a maximum current can be less than 600 mA. When the electric air pump 2 is powered by a 5V power supply, the average current can be less than 250 mA and the maximum current can be less than 350 mA. Taking the mobile phone power as an example, as it takes about one minute each time, it only consumes less than one percent of the mobile phone power.

The hook 4 can be a clasp detachably connected to the housing 1. In this embodiment, the hook 4 can be a lobster clasp, which generally includes a hook-shaped body 40, an opening and closing button 41 and an annular connecting head 42. The opening and closing button 41 is connected to the hook-shaped body 40 by an elastic device, and the annular connecting head 42 is connected to a tail end of the hook-shaped body 40. When the opening and closing button 41 is released, the hook-shaped body 40 is in a closed state. When the opening and closing button 41 is pressed, the hook-shaped body 40 is in an open state so as to hook an object. Besides the lobster clasp, the hook 4 also can be other types of detachable and lockable clasps.

The zipper tab assembly with exhausting/inflating functions of the present invention further includes a protecting cover 5 sheathing with the housing 1 and for protecting the input port 32 of the power terminal 3 and the vacuum extraction nozzle 21 and/or the inflation nozzle 22 when the exhausting and inflating functions are not utilized. The protecting cover 5 can be a hollow structure enclosed by a first cover wall 51, a second cover wall 52, a third cover wall 53 and a fourth cover wall 54. The first cover wall 51 and the second cover wall 52 are disposed opposite to each other and respectively located outside the first shell wall 11 and the second shell wall 12. The third cover wall 53 is connected to the first cover wall 51 and the second cover wall 52, and the fourth cover wall 54 is connected to the first cover wall 51 and the second cover wall 52. A connecting ring 530 is disposed on an outer surface of the third cover wall 53, and the annular connecting head 42 of the lobster clasp is connected with the connecting ring 530.

The protecting cover 5 can be rotatably connected to the housing 1 via a rotary mechanism, which is not shown in figures. When the protecting cover 5 rotates to a position where the third cover wall 53 covers the power interface 131, the fourth cover wall 54 covers the exhausting and inflating interface 132, and the first cover wall 51 and the second cover wall 52 respectively cover the first shell wall 11 and the second shell wall 12. Preferably, two arc notches 50 are formed on edges of the first cover wall 51 and the second cover wall 52 and located in positions corresponding to each other. Preferably, a protecting slot 531 is formed inside the third shell wall 53 and for accommodating the input port 32 of the power terminal 3, and a shape of the protecting slot 531 can match an outer contour of the input port 32 of the power terminal 3. By the structural design of the arc notches 50, it is convenient for the user to stabilize the housing 1 when opening the protecting cover 5, which prevents the housing 1 from being interlocked as the protecting cover 5 is rotated, and is beneficial to the smooth opening and closing operation of the protecting cover 5.

Specifically, the rotary mechanism can be a rotary shaft, and a circular rotary groove 110 is disposed on an outer surface of the first shell wall 11. The rotary shaft is perpendicular to the outer surface of the first shell wall 11, one end of the rotary shaft is fixedly connected to an inner surface of the first cover wall 51, and the other end of the rotary shaft is engaged into the circular rotary groove 110 and pivotally connected to the circular rotary groove 110, so that the rotary shaft is rotatable along the circular rotary groove 110, and the protecting cover 5 is rotatable about the rotary shaft. Alternatively, one end of the rotary shaft is fixedly connected to the inner surface of the first cover wall 51, a shaft body of the rotary shaft passes through and is pivotally connected to the first shell wall 11 and the second shell wall 12, and the other end of the rotary shaft is fixedly connected to an inner surface of the second cover wall 52. The rotary mechanism also can be a circular rotary disk, and the circular rotary groove 110 can be disposed on a middle portion of the outer surface of the first shell wall 11. An outer edge of the circular rotary disk is engaged in the circular rotary groove 110 and pivotally connected to the circular rotary groove 110, and an outer surface of the circular rotary disk is fixedly connected to the inner surface of the first cover wall 51, so that the circular rotary disk is rotatable along the circular rotary groove 110, and the protecting cover 5 is rotated by the circular rotary disk. Besides, the rotary mechanism can have other configurations as long as the protecting cover 5 and the housing 1 can be rotated relative to each other.

Specifically, a total weight of the zipper tab assembly of the present invention can be less than 50 grams, so that it does not bring excessive weight burden on the zipper head of the user's clothes or backpack.

When the exhausting and inflating functions are not utilized, the protecting cover 5 can be folded with the housing 1, so as to cover the input port 32 of the power terminal 3, the vacuum extraction nozzle 21 and the inflation nozzle 22, as shown in FIG. 2. When it is desired to utilize the exhausting and inflating functions, the protecting cover 5 can be rotated relative to the housing 1, so as to expose the input port 32 of the power terminal 3, the vacuum extraction nozzle 21 and the inflation nozzle 22, as shown in FIG. 3.

Figure 4:
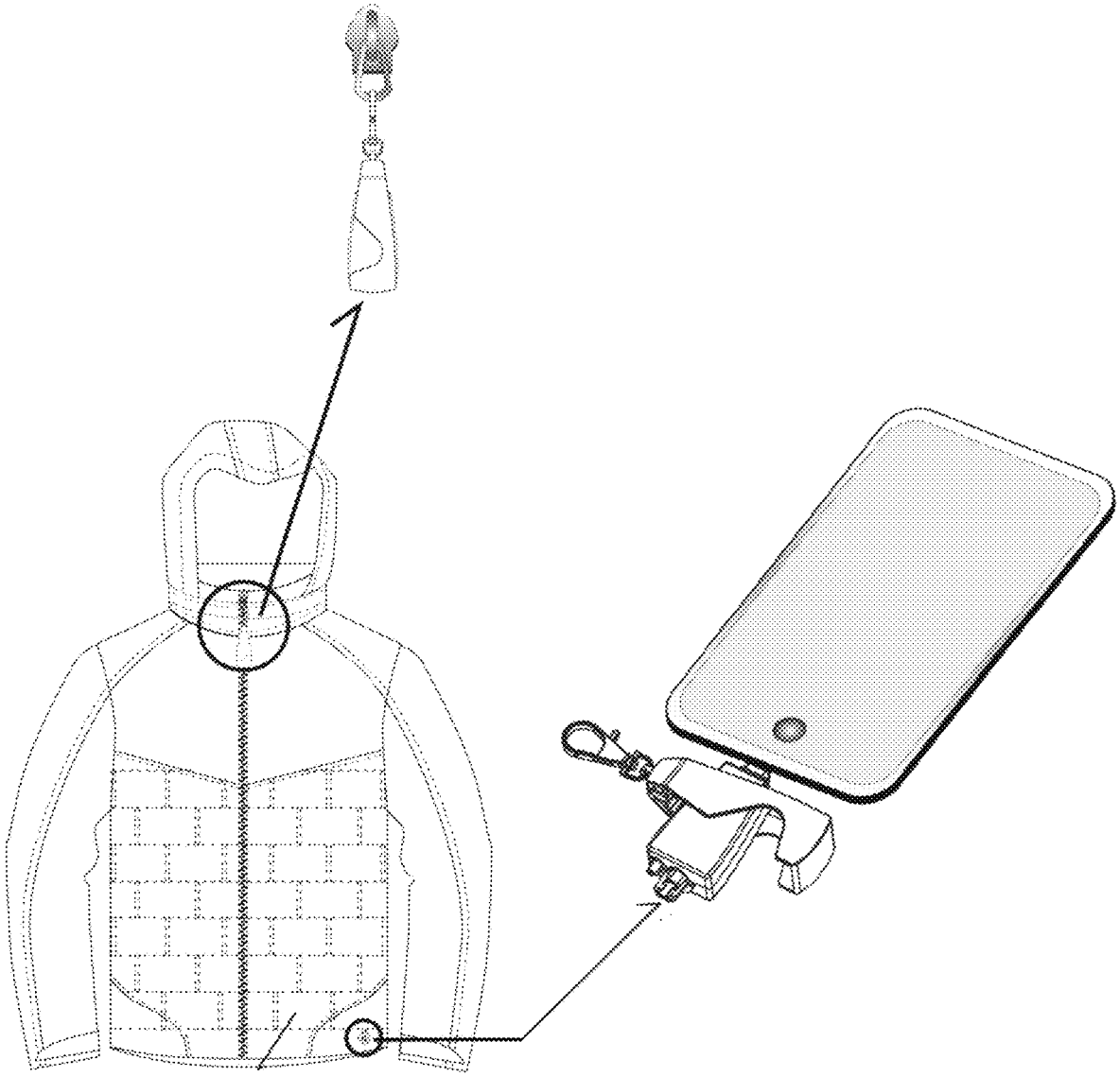
FIG. 4 is a diagram of the zipper tab assembly applied for inflatable clothes of the present invention.
Figure 5:
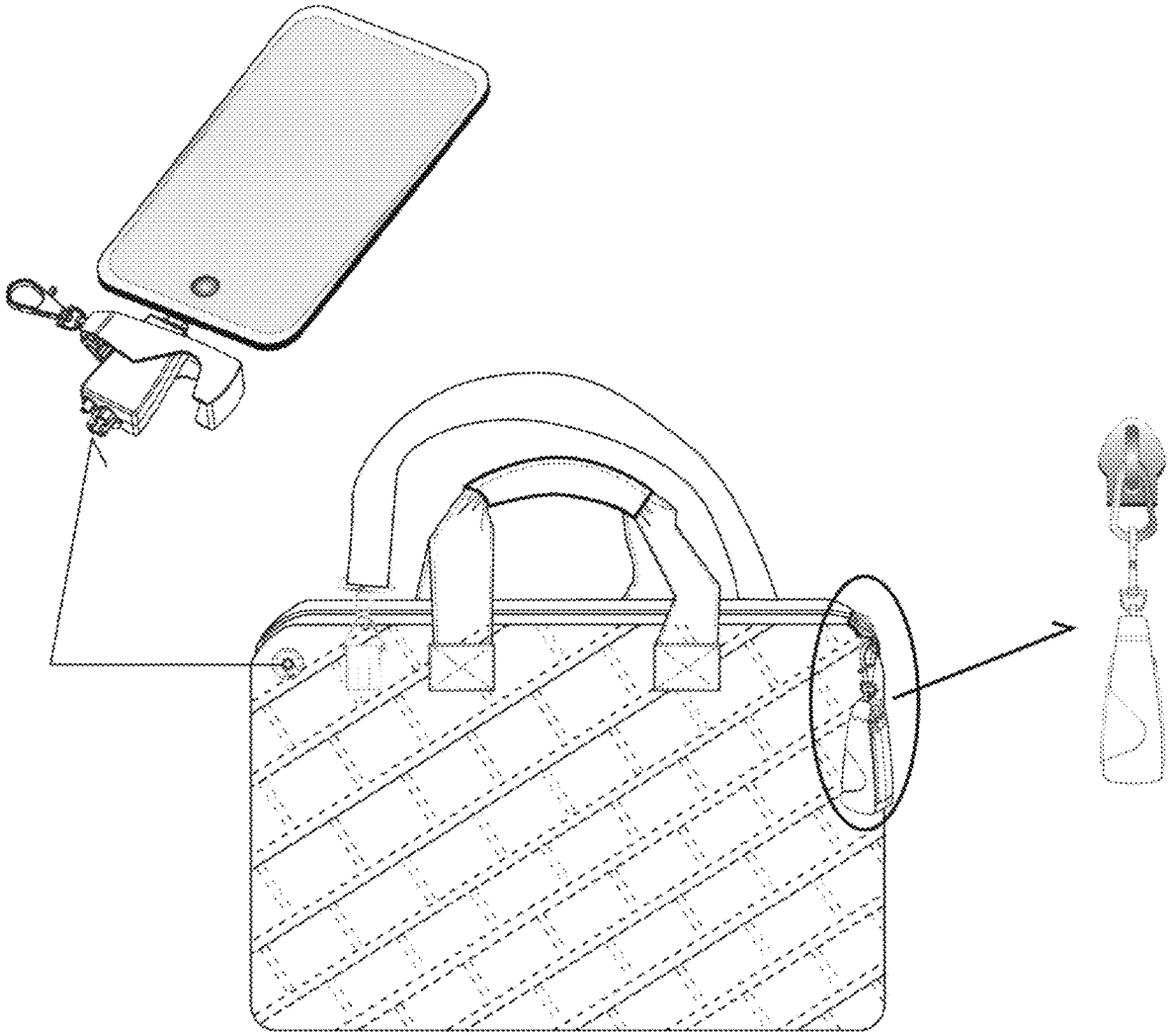
FIG. 5 is a diagram of the zipper tab assembly applied for an inflatable bag of the present invention.

The zipper tab assembly with the exhausting and inflating functions can be hung on the zipper head of the clothes or the luggage by the hook 4. When the object is required to be inflated or vacuumed, the zipper tab assembly can be taken out to connect with the object. For example, the zipper tab assembly can be electrified by connecting with a mobile phone, and an internal air bag of the inflatable clothes can be inflated through an inflation hole of the inflatable clothes by the zipper tab assembly, as shown in FIG. 4. Besides, the zipper tab assembly can be electrified by connecting with a mobile phone, and an internal air bag of an inflatable bag can be inflated through an inflation hole of the inflatable bag by the zipper tab assembly, as shown in FIG. 5.

Figure 6:
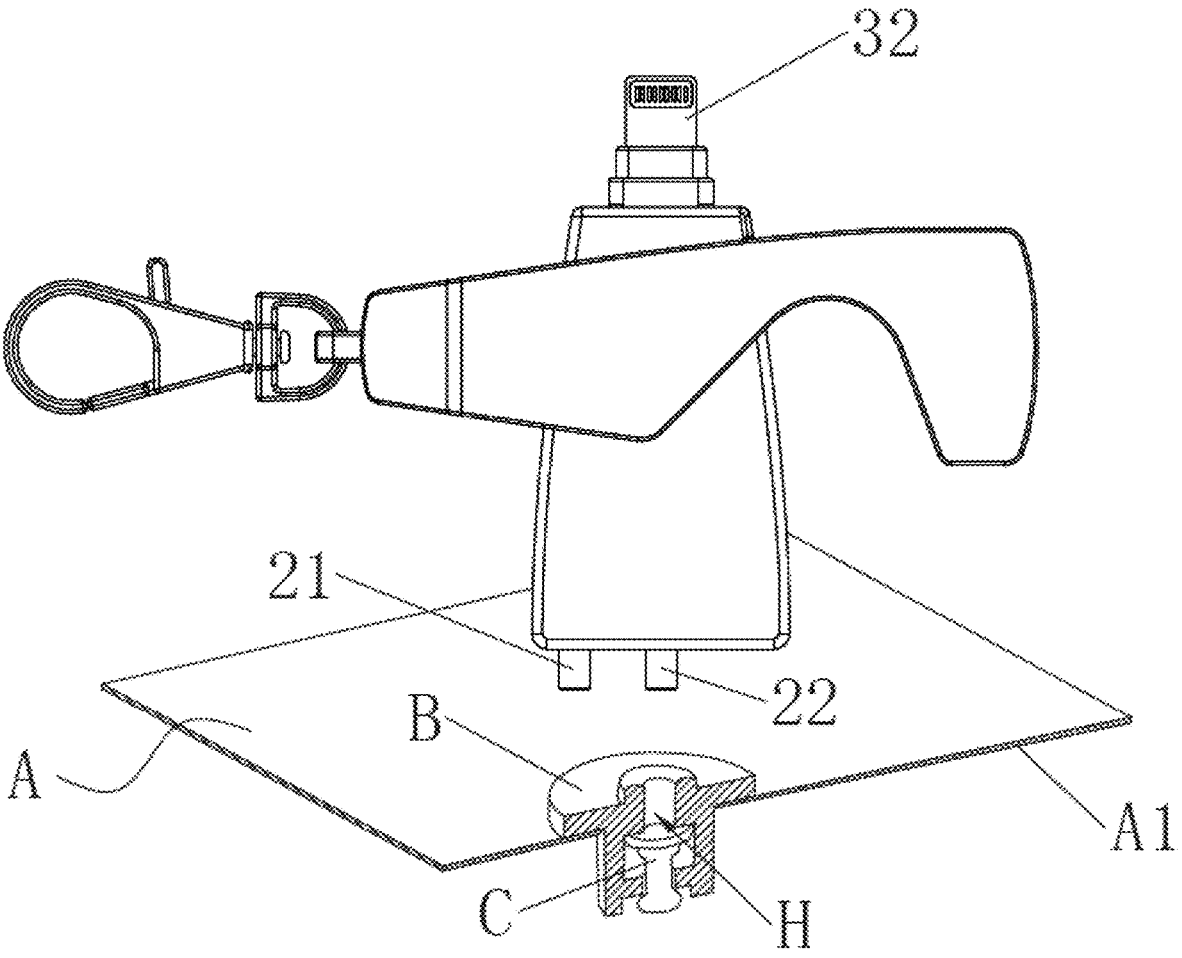
FIG. 6 is a diagram of a vacuum extraction nozzle and an inflation nozzle cooperating with an air seat of a bag body of the present invention.

As shown in FIG. 6, the vacuum extraction nozzle 21 and/or the inflation nozzle 22 can cooperate with an air seat B of a bag body A to ensure airtightness, which is advantageous for improving pumping efficiency. The air seat B is disposed in an outer layer A1 of the bag body A, a height of a portion of the air seat B, which is exposed out of the bag body A, can be 2.85 mm, and a height of another portion of the air seat B, which is hidden in the bag body A, can be 6.8 mm. A vent hole H is disposed on the air seat B. An aluminum nail C is disposed in the vent hole H, and the aluminum nail C is connected to the air seat B through a spring. When the vacuum extraction nozzle 21 and/or the inflation nozzle 22 are inserted into the vent hole H on the air seat B, the aluminum nail C is pressed against the inside of the bag body A, an end of the aluminum nail C is separated from an opening of the vent hole H, so as to open the vent hole H and communicate the vacuum extraction nozzle 21 and/or the inflation nozzle 22 with the inside of the bag body A, and then the bag body A can be inflated or vacuumed. After the vacuum extraction nozzle 21 and/or the inflation nozzle 22 are pulled out from the vent hole H on the air seat B, the spring recovers the aluminum nail C towards the outside of the bag body A, so that the end of the aluminum nail C blocks the opening of the air vent H, so as to close the air vent H and achieve the sealing of the bag body A.

In contrast to the prior art, the zipper tab assembly has pull function and at least one of exhausting and inflating functions by the electric air pump. Besides, the zipper tab assembly does not have any battery but uses the power terminal to connect with an external power source, such as a mobile phone or a mobile power source, which conforms to the current status of popular mobile phones, and it can safely pass the X-ray detector of the customs for smooth boarding. Moreover, there is no need to reserve extra space inside the zipper tab assembly for the battery, so the volume of the zipper tab assembly can be made small and the weight of the zipper tab assembly can be light. The hook of the zipper tab assembly can be easily hung on the zipper head of the clothes or the luggage. Or the hook can be hung on the keychain or the key case as an accessory for the user to carry around. Therefore, the zipper tab assembly of the present invention has exhausting and/or inflating functions and has the advantages of practicability, convenient utilization, small size, light weight, convenient wearing and convenient carrying.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A zipper tab assembly with at least one of exhausting and inflating functions, the zipper tab assembly comprising:

a housing comprising a first shell wall, a second shell wall, a first lateral wall and a second lateral wall, the first shell wall and the second shell wall being parallel to each other and formed in an isosceles trapezoid shape, an upper edge of each of the first shell wall and the second shell wall being less than 30 mm, a lower edge of each of the first shell wall and the second shell wall being less than 40 mm. a height of each of the first shell wall and the second shell wall being less than 110 mm, the first lateral wall being connected around the first shell wall, the second lateral wall being connected around the second shell wall, a power interface being disposed on sides of the first lateral wall and the second lateral wall corresponding to the upper edges of the first shell wall and the second shell wall, an exhausting and inflating interface being disposed on sides of the first lateral wall and second lateral wall corresponding to the lower edges of the first shell wall and the second shell wall;

an electric air pump disposed inside the housing and configured to exhaust or inflate, the electric air pump comprising at least one of a vacuum extraction nozzle and an inflation nozzle, the vacuum extraction nozzle and the inflation nozzle being communicated with an exterior of the housing, and the vacuum extraction nozzle and the inflation nozzle protruding out of the housing through the exhausting and inflating interface;

a power terminal comprising an input port and an output port, the input port protruding out of the housing through the power interface, and the output port being disposed inside the housing and electrically connected to the electric air pump; and a hook disposed outside the housing and connected to the housing.

2. The zipper tab assembly of claim 1, further comprising a protecting cover sheathing with the housing, the protecting cover being a hollow structure enclosed by a first cover wall, a second cover wall, a third cover wall and a fourth cover wall, the first cover wall and the second cover wall being disposed opposite to each other and located outside the first shell wall and the second shell wall, the protecting cover being rotatably connected to the housing via a rotary mechanism, and when the protecting cover rotates to a position where the third cover wall covers the power interface, the fourth cover wall covers the exhausting and inflating interface, and the first cover wall and the second cover wall respectively cover the first shell wall and the second shell wall.

3. The zipper tab assembly of claim 2, further comprising two arc notches formed on the first cover wall and the second cover wall and located in positions corresponding to each other.

4. The zipper tab assembly of claim 1, wherein a total weight of the zipper tab assembly is less than 50 grams.

5. The zipper tab assembly of claim 1, wherein the electric air pump has a volume of less than 10 L, a maximum inflation pressure of less than 10 psi, a minimum vacuum negative pressure of no more than −10 psi, and a maximum flow rate of less than 5 L/min.

6. The zipper tab assembly of claim 1, wherein the input port of the power terminal is a micro-USB plug, a Lighting plug or a Type-C plug.

7. The zipper tab assembly of claim 6, wherein when the electric air pump is powered by a 3V power supply, an average current is less than 450 mA and a maximum current is less than 600 mA, and when the electric air pump is powered by a 5V power supply, the average current is less than 250 mA and the maximum current is less than 350 mA.

8. The zipper tab assembly of claim 1, wherein the hook is a clasp detachably connected to the housing.

* * * * *